US005385666A

United States Patent [19]

Perlsweig

[11] Patent Number: 5,385,666

[45] Date of Patent: Jan. 31, 1995

[54] MEANS FOR RELEASING LEAVES AND DEBRIS FROM HAND-HELD SWIMMING POOL LEAF SKIMMER

[76] Inventor: Leon Perlsweig, 23017 Gainford St., Woodland Hills, Calif. 91364

[21] Appl. No.: 135,011

[22] Filed: Oct. 12, 1993

[51] Int. Cl.[6] ..... E04H 4/14

[52] U.S. Cl. ..... 210/169; 210/238; 210/471; 15/1.7; 4/496; 43/12

[58] Field of Search ..... 210/169, 237, 238, 470, 210/471; 15/1.7; 43/11, 12; 4/496

[56] References Cited

U.S. PATENT DOCUMENTS

| | | | |
|---|---|---|---|
| 525,619 | 9/1894 | Pearsons | 43/12 |
| 996,234 | 6/1911 | Fritz | 43/12 |
| 1,007,758 | 11/1911 | White | 43/11 |
| 2,619,755 | 12/1952 | Henson | 43/12 |
| 2,630,646 | 3/1953 | Jensen et al. | 43/12 |
| 3,032,908 | 5/1962 | Cohen et al. | 43/12 |
| 4,003,100 | 1/1977 | Whitaker | 15/1.7 |
| 4,446,646 | 5/1984 | van't Veld | 43/12 |
| 4,514,925 | 5/1985 | Rockwood | 43/12 |
| 4,571,875 | 2/1986 | Ballas | 43/11 |
| 4,815,227 | 3/1989 | Flanders, Sr. | 43/11 |
| 4,846,972 | 7/1989 | Anderson | 43/12 |
| 4,894,943 | 1/1990 | Allen et al. | 43/11 |

*Primary Examiner*—Stanley S. Silverman
*Assistant Examiner*—Robert James Popovics
*Attorney, Agent, or Firm*—Brumbaugh, Graves, Donohue & Raymond

[57] ABSTRACT

A skimmer assembly for swimming pools includes an arrangement to facilitate the emptying of debris from the skimmer basket. A handle is pivotally mounted along the skimmer pole near the end opposite the basket and an operating member is pivotally mounted along the pole near the basket. A flexible line interconnects the handle, the operating member and the basket such that when the skimmer assembly is rotated 180° about its axis and the handle pivoted to its emptying position, the operating member is raised to extend the basket to an inverted, open position, thereby allowing collected debris to fall freely from the basket into a receptacle. The skimmer assembly allows the user to empty the basket without having to touch the basket.

5 Claims, 1 Drawing Sheet

MEANS FOR RELEASING LEAVES AND DEBRIS FROM HAND-HELD SWIMMING POOL LEAF SKIMMER

BACKGROUND OF THE INVENTION

1. Field of the Invention

This invention relates to the cleaning of swimming pools and more particularly to a means for more conveniently unloading leaves and swimming pool debris from a hand-held leaf skimmer.

2.Description of the Prior Art

Skimmers for cleaning swimming pools and other water containing structures have been known and used in the past. The typical hand-operated leaf skimmer is little more than an elongated (8'–16' long) pole to which is attached at one end, a porous basket made from a filament or thread woven into a fabric with the characteristics of screening material, which permits water to flow out of the basket as it collects and traps leaves and debris skimmed from the surface or beneath the surface of a swimming pool.

A problem arises with the conventional skimmer when the leaves have to be dumped from the basket. In turning the basket opening-down to dump the leaves, the basket, because it is limp and flexible, falls over, thus trapping the leaves in the basket. The leaves can only be released if the user pulls the basket within his reach so he can grasp the bottom end of the basket with one hand to pull the bottom end up to allow the basket contents to fall out. At the same time, the user has to hold the pole with his other hand to steady the basket so that the leaves fall into the trash barrel opening and not on the ground outside the trash barrel. This inconvenience is especially significant to those who make a business out of maintaining swimming pools, because of the extra time and energy thus consumed.

The present invention eliminates the need for the user to reach for the loaded basket along the full length of the pole, or even to touch the loaded basket, in order to empty it, allowing the user to work more efficiently and keep his hands and clothing clean and dry.

SUMMARY OF THE INVENTION

The leaf skimmer assembly of the present invention comprises a planar frame having a central opening therethrough connected to one end of an elongated tubular pole, a porous flexible net or basket connected to the planar frame across the central opening for collecting leaves and other debris as the frame is moved across and through the water, and retracting means for retracting the flexible net away from the planar frame to permit the contents of the net to fall freely into a suitable receptacle.

In the preferred embodiment of the present invention, the retracting means comprises a handle pivotally mounted on the pole adjacent the end opposite the basket, an operating member having one end pivotally connected to the pole at a point spaced from but near the basket end of the pole and its other, free, end adjacent the basket, and a flexible line or string extending from the handle member through an eyelet on the free end of the operating member to the bottom of the basket. In skimming position, the handle and operating member are retained in their rest positions below and up against the pole. The handle is retained in its rest position by a spring clip mounted on the pole and a torsion spring on the pivotal mount of the operating member maintains the latter in its rest position. When it is desired to empty the basket, the pole is rotated 180° about its axis so that the handle and operating members are on the upper side of the pole and the basket is collapsed with its contents hanging over the edge of the basket frame. The user then grasps the free end of the handle, lifts it to disengage it from the spring clip and rotates it 180° about its pivot point to lie along the pole. This movement raises the operating member to pull the basket upward into an extended position, thereby allowing the contents of the basket to fall freely into the receptacle.

The object of the present invention is to provide an improved leaf skimmer assembly in which the components are configured in a manner to facilitate more efficient and easier unloading of the leaves and debris contained in the basket than is capable with skimmers of conventional design.

BRIEF DESCRIPTION OF THE DRAWINGS

The foregoing and other objects, features and advantages of the invention will become apparent from the following detailed description thereof taken in conjunction with the appended drawings in which.

DETAILED DESCRIPTION OF THE PREFERRED EMBODIMENT

Figure 1:
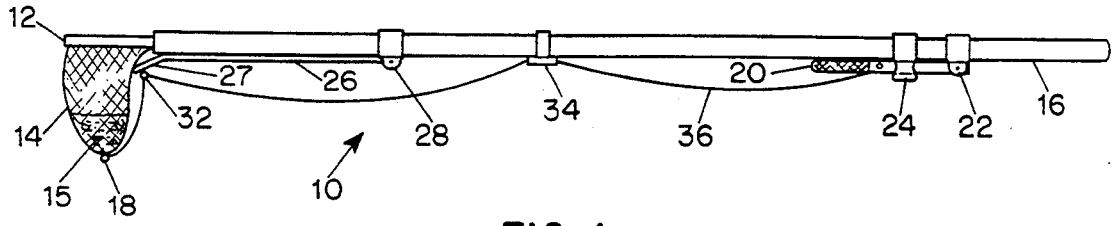
FIG. 1 is a side view of the skimmer assembly of the invention with the net extended in its skimming position.
Figure 2:
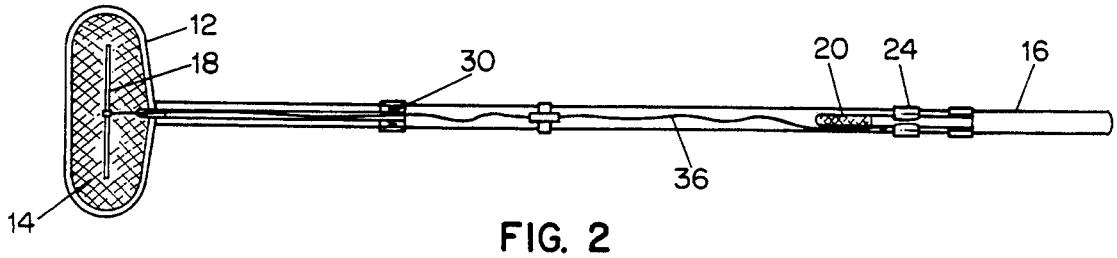
FIG. 2 is a view from below of the skimmer assembly of FIG. 1.

The leaf skimmer assembly of the present invention is indicated generally by the numeral 10 in the drawings. As shown in FIGS. 1 and 2, the skimmer assembly has a planar frame 12 to which a porous flexible net or basket 14 is fastened. The frame is mounted at one end of a pole 16 in conventional fashion. The pole 16 may be a single length of tubing of appropriate length or may be formed of two or more telescoping sections, in a manner known in the art. In either case, the pole should be of lightweight, rust-resistant material, such as aluminum or plastic.

In addition to the basic pole and basket arrangement, the skimmer of the present invention includes structure for emptying the basket of debris 15, as generally described above. This structure, as seen in FIGS. 1 and 2, includes a handle 20 which is pivotally mounted on collar 22 affixed to the pole 16 near its handle end. A second collar 24, having downwardly depending spring fingers, is fixed on the pole and positioned to retain the handle in its forward position against the underside of the pole, as shown in FIGS. 1 and 2.

At the basket end of the pole 16 is the operating mechanism for extending the basket for emptying. This mechanism comprises operating member 26 pivotally mounted in collar 28 on pole 16 and having a downwardly angled portion 27 (as viewed in FIG. 1) at its end adjacent the basket 14. A torsion spring 30 is provided within the collar 28 around the pivot pin joining the member 26 to the collar 28, to urge the member 26 normally against the underside of the pole 16 as shown in FIG. 1.

Along the bottom of the basket 14 is a rod or stiffening member 18 to which a flexible string or line 36 is attached. The line 36 is threaded through an eyelet 32 at the tip of the angled portion 27 of operating member 26, through a guide tube 34 mounted on a collar attached to the pole between the operating assembly and the handle assembly, and finally fixed to the handle 20 at a point approximately midway between its ends.

Figure 3A:
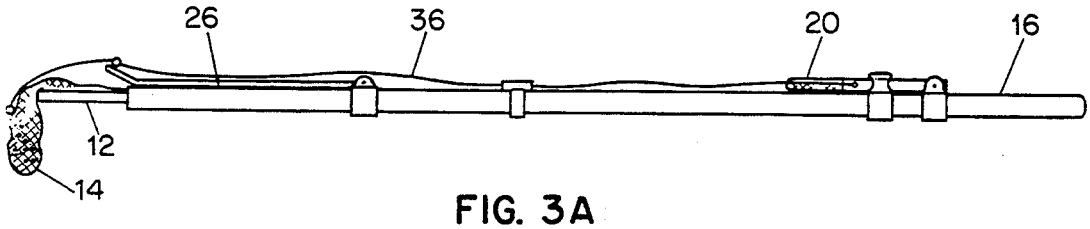
FIG. 3A illustrates the skimmer assembly after rotation by the user to trap debris in the net.
Figure 3B:
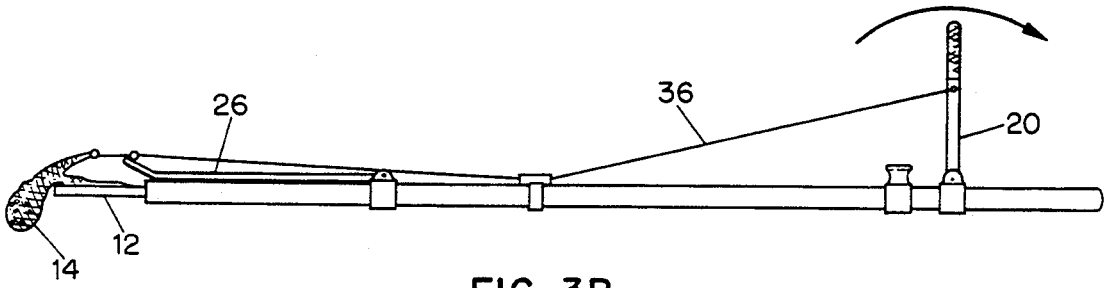
FIG. 3B illustrates the rotated skimmer assembly with the handle member of the retracting means partially operated.
Figure 3C:
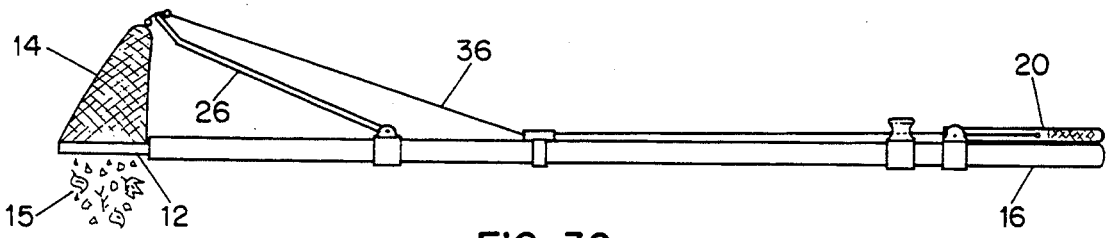
FIG. 3C illustrates the rotated skimmer assembly with the handle member fully operated to extend the net and permit debris to fall.

Operation of the novel skimmer assembly of the invention is illustrated in FIGS. 3A, B and C. After skimming a pool in the usual manner, the basket 14 will accumulate leaves and other debris 15 as indicated in FIG. 1. When it is desired to empty the basket 14, the user rotates the entire assembly 180° about the axis of the pole so that the basket, with its contents, lies across and over the edge of the frame 12, as seen in FIG. 3A. This traps the debris in the basket 14. The handle 20 is then manually pivoted about its pivot point 22 from its forward position towards the handle end of the pole 16, as shown in FIG. 3B, to apply tension to the line 36 and pull the bottom of the basket towards the handle end. Upon complete actuation of the handle, it is pivoted 180° and lies above and along the pole 16 in its rearward position, as shown in FIG. 3C. The length of the line 36 is such that in the operated position of the handle 20, the operating member 26 is pulled upwardly along with the bottom of the basket 14 against the action of spring 30, thereby extending the basket in an open position to allow debris contained therein to fall freely into a waiting receptacle.

It will thus be seen that the skimmer basket can be readily emptied without the necessity of the user reaching for the basket and grasping it with his hand to extend it. Not only does this save effort and time in completing a pool cleaning process, it protects the hands of the skimmer from contact with water and the debris collected.

To release the basket after emptying and return it to its skimming position, the handle 20 is rotated back from its rearward position in FIG. 3C to its forward position between the spring clamp members of collar 24, as in FIG. 3A. The resultant relaxation of tension on the line 36 allows operating member 26 to return to its rest position by virtue of the action of torsion spring 30 and permits the basket to collapse. Rotating the pole 180° to the position shown in FIG. 1 allows the basket to fall into its extended position and readies the assembly for further skimming.

Various modifications of the invention will occur to those skilled in the art and it is intended that the scope of protection be limited only by the appended claims.

I claim:

1. A swimming pool skimmer having:

an elongated pole;

an open frame fastened to one end of said pole, the other end of said pole adapted to be held by the user, a porous, flexible basket carried by said frame and normally hanging below said frame in an extended, open position to facilitate collecting and holding debris during skimming, and manually actuatable means mounted on said pole and connected to said basket for extending said basket in an open position above said frame when said pole and basket are rotated about the axis of the pole 180° from their position during skimming to permit debris collected in said basket to fall freely therefrom, said manually actuatable means comprising: an elongated handle having one end pivotally coupled to said pole at a point near said other end of said pole and manually movable from a first position lying along said pole on one side of said pivot point to a second position along said pole on the other side of said pivot point, an operating member movably mounted on said pole, and means interconnecting said handle, said operating member and said basket, whereby upon movement of said handle from said first position to said second position said operating member is moved to extend said basket.

2. The skimmer assembly of claim 1 further comprising spring clip means carried by said pole for normally retaining said handle in said first position.

3. The skimmer assembly of claim 1 wherein said operating member comprises an elongated rod having one end pivotally coupled to said pole near said one end of said pole, the other end of said operating member extending along said pole in proximity to said basket, and spring means normally urging said operating member to lie along said pole.

4. The skimmer assembly of claim 3 wherein said other end of said operating member is provided with an opening and wherein said interconnecting means comprises a flexible line having one end fixed to said handle and the other end fixed to the bottom of said basket, said line passing through the opening in said other end of the operating member.

5. The skimmer assembly of claim 4 further comprising guide means carried on said pole through which said flexible line passes.

* * * * *